US006581581B1

(12) United States Patent
Bebich

(10) Patent No.: US 6,581,581 B1
(45) **Date of Patent: *Jun. 24, 2003**

(54) IGNITION BY ELECTROMAGNETIC RADIATION

(76) Inventor: Matthew Mark Bebich, 78 Roberts Street, Osborne Park, Western Australia (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/269,651

(22) PCT Filed: Sep. 30, 1997

(86) PCT No.: PCT/AU97/00652

§ 371 (c)(1),
(2), (4) Date: Dec. 3, 1999

(87) PCT Pub. No.: WO98/14703

PCT Pub. Date: Apr. 9, 1998

(30) Foreign Application Priority Data

Sep. 30, 1996 (GB) ..... 9620318

(51) Int. Cl.[7] ..... F02P 23/04
(52) U.S. Cl. ..... 123/536
(58) Field of Search ..... 123/536, 537, 123/538, 539

(56) References Cited

U.S. PATENT DOCUMENTS

| | | | | | |
|---|---|---|---|---|---|
| 3,672,341 | A | * | 6/1972 | Smith et al. | 123/536 |
| 4,380,978 | A | * | 4/1983 | Maynard et al. | 123/536 |
| 4,401,089 | A | * | 8/1983 | Csaszar et al. | 123/536 |
| 4,446,826 | A | | 5/1984 | Kimura et al. | |
| 4,499,872 | A | * | 2/1985 | Ward et al. | 123/536 |
| 4,556,020 | A | | 12/1985 | Hickling | 123/143 B |
| 4,726,336 | A | | 2/1988 | Hoppie et al. | |
| 5,027,764 | A | * | 7/1991 | Reimann | 123/536 |
| 5,154,142 | A | * | 10/1992 | Kamo | 123/536 |
| 5,423,306 | A | | 6/1995 | Trigger et al. | |
| 5,983,871 | A | * | 11/1999 | Gordon et al. | 123/536 |

FOREIGN PATENT DOCUMENTS

| | | |
|---|---|---|
| EP | 0 055 871 | 7/1982 |
| EP | 0 290 154 | 11/1988 |
| GB | 2 199 075 | 6/1988 |
| JP | 7-229453 | 8/1995 |
| RU | 2049243 | 11/1995 |
| WO | WO 94/08131 | 4/1994 |

OTHER PUBLICATIONS

Patent Abstracts of Japan, M–372; JP 59–215967 A; Toyota Jidosha K.K.; "Assisting Device of Start in Engine;" Dec. 5, 1984; p. 161.
Patent Abstracts of Japan, M–672; JP 62–210263 A; Hitachi Seisakusho K.K.; "Combustion Promoting Device for Internal Combustion Engine;" Sep. 16, 1987; p. 73.
Patent Abstracts of Japan, M–167; JP 57–119164 A; Hitachi Seisakusho K.K.; "Combined Ignition Engine by Laser and Microwave Plasma;" Jul. 24, 1982; p. 124.
Abstract of JP 7–229453, *Patent Abstract of Japan*, 1 page.

* cited by examiner

*Primary Examiner*—Marguerite McMahon
(74) *Attorney, Agent, or Firm*—Ladas & Parry

(57) ABSTRACT

An ignition system (1) comprising fuel atomising means (6) for spraying fuel (10) therefrom for introduction into a combustion chamber (2). An electro-magnetic radiation generator (8) is connected to an emitter (12) which emits electro-magnetic radiation (11). The electro-magnetic radiation (11) irradiates the fuel (10) to cause ionisation and combustion of the fuel (10). A magnetic field may be provided in the combustion chamber to enhance atomic ionisation of the fuel in the combustion chamber.

90 Claims, 4 Drawing Sheets

IGNITION BY ELECTROMAGNETIC RADIATION

FIELD OF INVENTION

The present invention relates to an ignition system.

The ignition system of the present invention may be used in any suitable application where an engine is used for propulsion to provide drive to tools and other equipment or other purposes or activities.

BACKGROUND OF THE INVENTION

Modern combustion engines utilise the primordial principles of the early steam engine, for example a crank shaft, a piston, a combustion chamber, a cylinder head and an engine block. The major difference is the utilisation of fossilised hydrocarbon fuels or liquefied natural gases as energy means in lieu of steam. Innovation over time led to the development of multi-cylinder and more compact engines having very advanced components.

The modern automobile engine does not utilise steam energy because of the availability of hydrocarbon fuels and other forms of energy such as, for example, liquefied natural gas and methanols. Hydrocarbon fuels are widely used in engines of contemporary cars, trucks, tractors, generators, motor cycles, jet engines and other applications and have proved to be more effective and efficient as a source of energy than steam.

The use of steam as an energy source requires considerable heating of water to produce kinetic energy. Heating water into steam for example, was accomplished via boilers utilising large quantities of wood or coal.

One disadvantage of using steam engines is the need for large volumes of water, particularly when required to be carried on board a vehicle, ie the traditional steam engine locomotive. Also, large amounts of coal or wood also needed to be stored and carried to provide heating energy to transform water into steam. Steam engines were often very reliable but messy to maintain and operate. Steam production necessitated the constant need for stoking the boiler fires to create heat. Furthermore, use of steam engines is not possible in modern cars because they cannot accommodate the conventional fuels used in older steam engines.

Another disadvantage of using fuels such as wood and coal is the distances often travelled far away from suitable collieries and wood depots for re-supply. Furthermore, the capability of boilers to cause fires as a result of sparks or overheating phenomena is another disadvantage. Smoke from steam engine boilers also caused a disadvantage and use of chimneys or flues was required which cannot be used on modern automobiles.

It is for reasons such as the above that steam engines were considered inefficient, too clumsy, too heavy and too awkward to operate and maintain.

Fossilised fuels are supplied from petroleum service stations virtually world-wide and re-fuelling a motor car is easier than loading several tonnes of wood or coal onto a steam engine locomotive. Typically, automobiles utlising hydrocarbon fuels or liquefied natural gas sources are more reliable and easier to operate and maintain.

The advent of the modern automobile engine utilising fossilised fuels came about through the works of Daimler, Otto and Benz who invented the first series of hydrocarbon engines which used an oil and kerosene blend (now called Diesel). This hydrocarbon blend fuel self-detonated without spark plugs within a combustion chamber when pressurised with an oxygen lean mixture at a minimum compression ratio of 12:1. Below the ratio of 12:1 the Diesel fuel and oxygen mixture will not self detonate and combustion will not occur within the chamber. Typically, Diesel engines operate at compression ratios up to 34:1 to facilitate detonation and maximise horsepower ratings and torque. The Diesel engine still is one of the most efficient motors for transportation and other industrial uses, and does not rely on an electrical ignition source for combustion.

The advent of other lighter blends of petroleum such as leaded gasoline (or petrol), and in recent years unleaded gasolines, gave an impetus to the automotive industry. Gasoline engines are widely used in transportation as well as for other industrial and recreational applications. The advent of the gasoline driven engine was made possible by the invention of the Bosch electrical ignition system.

Hence, the modern automobile ignition system typically consists of an electrical input current derived from a 12 Volt DC lead-acid battery, a coil, a condenser or capacitor, a rotor with copper electrode attached and a set of point breakers. The rotor and point breakers are accommodated within a distributor assembly which is well insulated beneath a distributor cap. Insulated high tension electrical leads extend from the distributor assembly and attach to a spark plug(s) typically made from metal and ceramic compositions. The ceramic core provides electrical insulation with an internal copper or metallic core transcending the length of the ceramic core and into the base of the spark plug. The base of the spark plug consists of a threaded metal stub for screwing into the engine cylinder head. The spark plug typically has an air gap of approximately 0.6 mm–1.5 mm space to create a spark across the air gap within the combustion chamber when high voltage potential is delivered to the spark plug electrode via a high tension electrical lead. The distributor assembly is connected to the cam shaft to provide timing for the electrical ignition system.

The conventional spark plug can typically be manufactured having either one air gap point between the electrode and the metallic base, or a plurality of gaps for multiple sparking. Some conventional spark plugs are manufactured without a metal strip over the electrode to create an air gap. Instead such spark plugs rely on high voltage sparking from the electrode across to the metal base of the plug, which is earthed to the engine's cylinder head.

With the exception of Diesel engines, all gasoline driven engines utilise electrical ignition systems. High voltage currents are delivered to the spark plug. The lean fuel and air mixture is contained within a combustion chamber. When the piston is near to, or directly at, extreme top dead centre the lean fuel and air mixture is under elevated pressure. At this point the spark plug ignites the lean fuel and air mixture. DC Voltages of 30,000 to 40,000 volts are usual in electrical ignition systems. However, some manufacturers supply ignition systems exceeding these values, e.g. up to 70,000 volts, or even being lower, e.g. down to 20,000 volts.

A disadvantage of utilising conventional ignition systems and conventional spark plugs is that high electrical potential rapidly deteriorates the spark plugs. Therefore, spark plugs often need to be replaced frequently.

Furthermore, another disadvantage of conventional spark plugs is that they often become blocked or clogged with build up of carbon depositions caused by a combination of burnt and unburned fossilised fuels. When carbon deposits build up onto spark plugs, electrical sparking is sacrificed dues to the electrical conductivity of carbon. Sometimes, in extreme cases, no sparking eventuates and proper combustion does not ensue. This means that unburned fossil fuels are expelled from the engine's exhaust system thereby creating environmental pollution.

Often, improper sparking of spark plugs causes engines to not idle and run smoothly. Improper spark plug care or maintenance can result in a gradual deterioration of the combustion engine through carbon build up and through a phenomena known as engine glazing. Fuel efficiency also diminishes and an automobile become sluggish leading to loss of speed and horsepower performance.

Possibly, the greatest disadvantage of utilising fossilised fuels and liquefied natural gas energy sources is that modern car engines are highly inefficient. The modern automobile gasoline engines are only between 30–40 percent efficient and most fuel entering the combustion chamber does not properly combust and turn into heat or energy. The unburned fuels are exhausted from the combustion chamber from the engine via an exhaust system and into the atmosphere thus contributing to air pollution.

Another disadvantage of utilising fossilised hydrocarbon fuels and natural gas as energy sources is the associated high prices which continue to escalate as the Earth's petroleum resources are being diminished. Fossilised fuel reserves are limited in supply and as the oil reserves continue to be depleted, the prices will increase.

Furthermore, use of fossilised fuels contributes to air pollution on our planet and many environmental authorities around the world are becoming increasingly concerned about the ozone layer and the green house effect. Measures such as increasing the import duties and taxes on fossilised fuels by governments help to reduce fuel consumption by increasing their price to consumers.

Clearly, a cleaner energy source which is cost effective and more replenishable is desirable. Alternatively, the manufacture of an alternative means of transportation or a more effective engine as a means of locomotion may achieve the desirable effect.

SUMMARY OF THE INVENTION

In accordance with a first aspect of the present invention there is provided an ignition system comprising fuel atomising means for spraying fuel therefrom for introduction into a combustion chamber, electro-magnetic radiation generator means to generate electromagnetic radiation, emitter means connected with said electro-magnetic radiation generator means to emit said electro-magnetic radiation generated by said electro-magnetic radiation generator means and magnetic field creation means positioned exterior of the combustion chamber in proximity to said fuel atomising means, wherein said magnetic field creation means is provided to create at least one magnetic field and said electro-magnetic radiation emitted by said emitter means irradiates fuel in the presence of said at least one magnetic field created by said magnetic field creation means to heat and ionize fuel and combust fuel in the combustion chamber.

In accordance with a second aspect of the present invention there is provided a method of ignition of fuel in a combustion chamber comprising generating and emitting electro-magnetic radiation, spraying fuel from fuel atomising means for introduction into the combustion chamber, creating at least one magnetic field from exterior of the combustion chamber in proximity to the fuel atomising means and irradiating fuel with said electro-magnetic radiation in the presence of said at least one magnetic field to heat and ionise fuel and combust fuel.

Preferably, the electro-magnetic radiation is matched to the resonant frequency of the fuel.

The magnetic field enhances atomic ionisation and causes nuclear magnetisation of selected atoms of the fuel. This enhances dissociation of the fuel atoms.

Such magnetic fields may be created by one or more magnets chamber as the magnetic field creation means.

The emitter means may be provided with an in-built magnet to induce a magnetic flux density in the vicinity of the emitter means to enhance atomic ionisation and cause nuclear magnetisation of atoms of the fuel. However, emitter means without magnetic components may also be used.

When the irradiation of the fuel by the electro-magnetic radiation occurs in the combustion chamber, one or more magnets may be provided on the casing of the combustion chamber, e.g. the cylinder head, to create a magnetic field in the combustion chamber. The magnets may be removably retained, e.g. by screwing, in the cylinder head.

The magnets may be provided interior as well as exterior of the combustion chamber. If the magnets are also provided interior of the combustion chamber, they need to be of a type that are able to tolerate the high temperatures and pressures that arise in the combustion chamber during the combustion process.

A piston which reciprocates inside the combustion chamber in the cylinder head (to bound the combustion chamber) may also be provided with one or more (additional) magnets. The piston may be provided with such magnets as an alternative to, or in addition to, the magnets provided in the cylinder head itself.

In an arrangement where magnets are provided on both the piston and the cylinder head, during the upward stroke of the piston and at approximately top dead centre, the two like polarities of the magnets on the piston and cylinder head will repel and further contribute to ionisation of fuel in the combustion chamber.

Preferably, the emitter means is provided with an in-built magnet to induce a magnetic flux density in the vicinity of the emitter means and inside the combustion chamber to enhance atomic ionisation and nuclear magnetisation of atoms of the fuel. However, emitter means without magnetic components may also be used.

The magnets may be of any suitable type, including ceramic magnets, rare earth magnets and DC current magnets.

The use of ceramic magnets is preferred as such magnets are generally best able to absorb heat and not readily lose their magnetic flux density capabilities.

The use of magnets in the ignition system and method of the present invention enables atomic magnetic resonance of the fuel to be achieved to enhance the combustion process.

The magnetic fields created may have a magnetic flux density of substantially 0.05 Tesla to 2.0 Tesla.

Preferably, the electro-magnetic radiation generator means generates electro-magnetic radiation having frequencies with corresponding wavelengths that can be accommodated within the dimensions of the combustion chamber.

Preferably, the electro-magnetic radiation generator means generates resonant frequency electro-magnetic radiation for heating and ionisation of fuel.

Preferably, the electro-magnetic radiation generator means generates electro-magnetic radiation having a pulsed wave form or a continuous wave form.

Preferably, the electro magnetic radiation generator means generates electro-magnetic radiation whose frequencies are substantially in the range 100 MHz to 100 GHz.

Preferably, the frequencies employed are matched to the dimensional size of the combustion chamber to ensure that their corresponding wavelengths are of a size to fit in the combustion chamber, but do not form standing waves therein.

The preferred frequency of the electro-magnetic radiation generated by the electro-magnetic radiation generator means is 1420 MHz, subject to the combustion chamber having dimensions that can accommodate electro-magnetic radiation of such frequency with regard to the wavelength of such electro-magnetic radiation.

The electro-magnetic radiation generator means may be provided as a microwave generator, e.g. a magnetron or Klystron to generate microwave radiation.

The electro-magnetic radiation generator means preferably has an energy output in the range substantially from 200 watts to 10000 watts. However, lower and higher energy output electro-magnetic radiation generator means may also be used.

The fuel used in the ignition system and method of the present invention may be any substance or substances which are capable of ionisation and combustion by electro-magnetic radiation.

The ignition system and method of the present invention encompass the use of water as a fuel, the use of conventional hydrocarbon fuels, alcohols and the use of gases and other hydrogen rich compounds, and any combination thereof. The fuels may include additives to enhance combustion. The additives may include sugars, calcium cyclamate, gases and chemical additives. In the case of water used as the fuel, additives may also include hydrocarbon fuels or alcohol derivatives in addition to those just listed.

The fuel atomising means sprays fuel therefrom as a mist or fog of droplets which facilitates rapid heat absorption and enables complete saturation of the combustion chamber during the respiration, compression and ignition cycle. Typically, the fuel is sprayed such that the droplets have a mean value diameter of up to substantially 1000 microns, however larger diameters may also be used. Nevertheless it is preferred that the mean value diameter of the droplets is substantially up to 100 microns. However, most preferred, is the use of droplets having a size of from 1 to 5 microns.

Preferably, the fuel is sprayed from the fuel atomising means under elevated pressure. This occurs during the respiration cycle.

Spraying the fuel as a mist of droplets with small mean value diameters means that the droplets possess a large surface area to volume ratio and this enhances absorption of electro-magnetic radiation to cause rapid heating and expansion of the fuel.

An injector system may be used to provide the elevated pressure under which the fuel is sprayed. Alternatively, a pump may be used for this purpose. The injector system or pump may be provided in the fuel feed line leading to the fuel atomising nozzle from a fuel reservoir. Conveniently, the injector system or pump may be provided on the outside of the cylinder head just prior to the fuel entering the fuel atomising means. The fuel may be sprayed at a pressure substantially in the range from 50 bar to 250 bar.

The electro-magnetic radiation generator means may be connected directly with the emitter means. Alternatively, the electro-magnetic radiation generator means may be connected with the emitter means by connection means, such as waveguide means, e.g. one or more insulated, or shielded, co-axial cables, shielded fibre optical cables, or other waveguides.

The electro-magnetic radiation may be emitted directly into the combustion chamber by the emitter means and the fuel may be emitted directly into the combustion chamber by the fuel atomising means.

Alternatively, a pre-combustion chamber may be provided and the emitter means emits the electro-magnetic radiation into the pre-combustion chamber means and the fuel atomising means sprays the fuel into the pre-combustion chamber means such that the fuel is ionised and magnetised therein. This can be done in a similar manner as previously hereinbefore described when the combustion chamber is used for this purpose. A magnetic field may be created in the pre-combustion chamber means in a similar manner to the magnetic field which is created in the combustion chamber.

Accordingly, at least one magnet may be provided to create the magnetic field in the pre-combustion chamber. The magnet may, for example, be provided on the casing of the pre-combustion chamber or the emitter may be provided with the magnet. The pre-combustion chamber and the combustion chamber are in communication such that electro-magnetic radiation and fuel are able to pass from the pre-combustion chamber means to the combustion chamber.

Preferably, the electro-magnetic radiation generated by the electro-magnetic radiation generator means is emitted by the emitter means in bursts at pre-set times of the combustion cycle of the ignition system.

Preferably, timing means is provided and is arranged to generate square gating pulses such that the electro-magnetic radiation is emitted by the emitter means at the pre-set times. A reciprocating piston may be provided in the combustion chamber and the pre-set times correspond to pre-determined positions of the reciprocating piston. The reciprocating piston is caused to move by the combustion of fuel in the combustion chamber and creates rotational movement of the engine crank shaft in a conventional manner. However, in other engine types the piston is replaced with an analogous component. For example, in a rotary engine a rotor is used instead of reciprocating pistons.

Preferably, the timing means is arranged such that the emitter means emits the electro-magnetic radiation from a point prior to the reciprocating piston reaching top dead centre, (e.g. substantially 18° prior to top dead centre) up to the time prior to, or at, the completion of the downward stroke of the reciprocating piston to enhance heating of and substantially complete ionisation and combustion of the fuel in the combustion chamber. Thus, the emitter means emits the electro-magnetic radiation from a point prior to the reciprocating piston reaching top dead centre to a point after the reciprocating piston passes the dead centre but before, or at, the completion of the downward stroke of the piston.

Inlet means may be provided for intake of air during the respiration cycle of the combustion engine. Similarly, exhaust means is provided for exhaust of combustion products from the combustion chamber. The inlet means preferably comprises a one-way valve for intake of air.

Preferably, pressure relief means is provided such that if the internal pressure in the combustion chamber exceeds a selected level, the pressure relief means is activated to avoid over-pressurisation in the combustion chamber.

In the case of a reciprocating piston being provided in the combustion chamber, it is preferred that the reciprocating piston has at least one cavity therein to enhance reflection of the electro-magnetic radiation off the piston in different directions. In other engine types not employing reciprocating pistons, cavities may be provided on the components that are analogous to a reciprocating piston. Preferably, the fuel atomising means sprays fuel through a magnetic field. Such an arrangement is desirable to cause nuclear magnetic resonance of selected atoms, e.g. hydrogen and oxygen at certain frequencies. It is preferred that the fuel is sprayed through the magnetic field in a direction substantially at 90°angulation therethrough.

Preferably, the fuel atomising means and the emitter means are arranged such that they are opposed in an offset manner such that the electro-magnetic radiation is emitted and the fuel is sprayed such that they are opposed in an offset manner. It is further preferred that the fuel atomising means and the emitter means are offset by an angle of substantially 90°such that the electro-magnetic radiation is emitted and the fuel is sprayed such that they are offset by an angle of substantially 90°. This will ensure that atomic spectra (of fuel atoms) will undergo Larmor precession. Nuclear magnetic resonance will cause fine structure of atoms, e.g. hydrogen, which is the line splitting that arises from couplings between nuclear spins of atoms and which enhances dissociation of atoms for combustion.

Preferably, heating plug means is provided to provide additional heating of the fuel.

Initial starting energy input for the electro-magnet radiation generator means may be provided by an external power source, e.g. a battery in a similar manner to conventional ignition systems used in motor vehicles. Electrical voltages may, for example, be boosted by use of voltage doublers and triplers. Following initial starting, further supply of energy input to the electro-magnetic radiation generator means may be provided by alternator means, once again, in analogous manner to the operation of alternators in conventional ignition systems used in motor vehicles.

In addition to incorporation in newly manufactured engines, the ignition system of the present invention may be installed in pro-existing engines as a retrofit system. Accordingly, existing intake manifolds and intake valves of a pre-existing engine may be adapted for use with the ignition system of the present invention. Alteratively, the fuel atomising means may be mounted directly into the engine cylinder head of a pre-existing engine thereby avoiding the need for conventional air-fuel intakes, such as carburettors, present in conventional combustion engines.

It is contemplated that the ignition system of the present invention may be used in all varieties of combustion engines, whether of the piston type or non-piston type, e.g. such as rotary engines, turbines, other thrust engines, and rocket propulsion systems.

BRIEF DESCRIPTION OF THE DRAWINGS

The present invention will now be described, by way of example, with reference to the accompanying drawings, in which.

DESCRIPTION OF THE INVENTION

Figure 1:
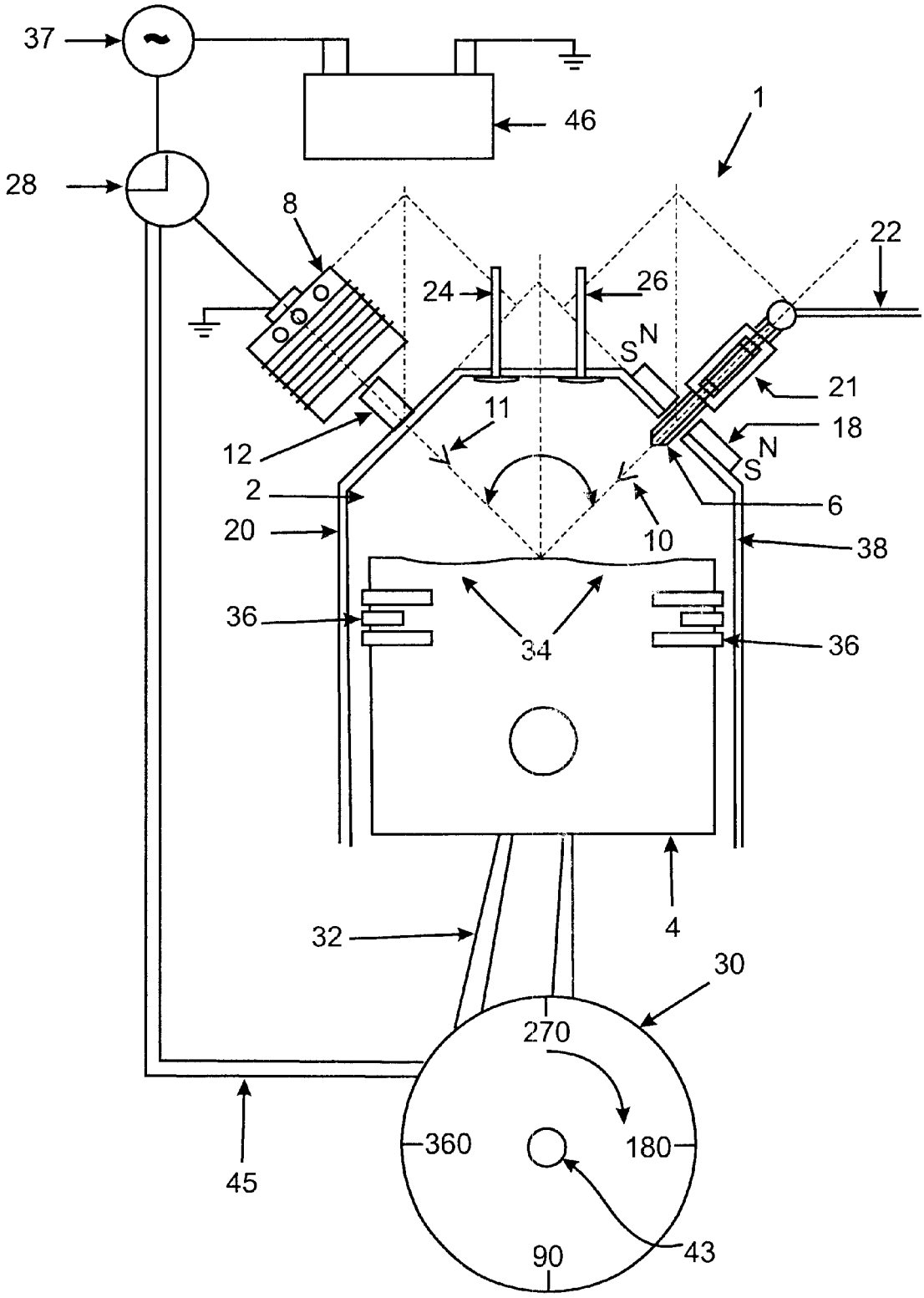
FIG. 1 is a schematic drawing showing a first embodiment of an ignition system in accordance with an aspect of the present invention.

FIG. 1 shows an ignition system 1 in accordance with an aspect of the present invention in use with an engine combustion chamber 2 having a reciprocating piston 4. The combustion chamber 2 itself forms part of an engine (not shown).

The ignition system 1 comprises a fuel atomising nozzle 6 and an electro-magnetic radiation generator 8. The fuel atomising nozzle 6 sprays fuel 10 therefrom. The fuel 10 is introduced into the combustion chamber 2. The electro-magnetic radiation generator 8 generates electro-magnetic radiation which can be emitted by an emitter 12 to irradiate fuel 10.

The fuel atomising nozzle 6 sprays the fuel 10 into the combustion chamber 2. The emitter is able to emit electro-magnetic radiation 11 into the combustion chamber 2.

A magnet 18 is attached to the cylinder head 20 which houses the combustion chamber 2. The magnet 18 is arranged such that the fuel atomising nozzle 6 sprays the fuels 10 through the magnetic field created by the magnet 18.

The magnet 18 may, for example, be a permanent rare earth magnet creating a magnetic flux density of from substantially 0.6 tesla to 2.0 tesla. However, other magnetic flux densities may also be used.

Fuel 10 is delivered to the fuel atomising nozzle 6 from a reservoir (not shown) via a fuel food line 22.

The fuel 10 is pumped under elevated pressure through an injector system 21. The injector system 21 is analogous to the injection system of a Diesel engine and it is to be understood that the injector system 21 may be of conventional form. The fuel atomising nozzle 6 may form part of the injector system 21.

Metering of fuel 10 under elevated pressure through the injector system 21 for introduction into the combustion chamber 2 is important in order to govern the amount of energy required during combustion of the fuel 10. The volume of fuel 10 required will be dictated by the size of the engine's combustion chamber 2 and the desired horsepower (kilowatt) ratings. Acceleration, or increase in speed, of the engine output using the ignition system 1 is similar to conventional gasoline or Diesel operated engines whereby additional fuel 10 is introduced into the combustion chamber 2 via the fuel atomising nozzle 6.

The fuel 10 is sprayed from the fuel atomising nozzle 6 as a fine mist or fog. Generally, the finer the mist or fog droplets, the better and more efficient detonation and combustion of the fuel 10 will be.

The outlet of the fuel atomising nozzle 6 is small to enable very small doses of fuel mist at relatively small droplet sizes to be introduced into the combustion chamber 2. Excessive fuel mist injection may undesirably cause severe detonation resulting in irreparable damage to the engine components. The fuel mist or fog droplets may typically be up to 1000 microns or greater, in mean value diameter.

Preferably, the fuel mist or fog droplets have a mean value diameter of up to 100 microns.

Most preferred, is fuel mist or fog droplets having a mean value diameter of between 1–5 microns.

Small fuel mist or fog droplet sizes facilitate stoichiometric mixtures, rapid heat absorption and enable complete saturation of the combustion chamber 2 during the engine respiration, compression and ignition cycles.

In situations where the use of an injector type system is impracticable or not possible on engines, a small DC electrically driven high pressure low volume flow pump can be used to obtain satisfactory results.

The fuel atomising nozzle 6 may be constructed from steel or other metals, including alloys and non-alloys, provided that they can tolerate the heat and pressure generated in proximate location to the combustion chamber 2.

The emitter 12 is connected directly to the electro-magnetic radiation generator 8.

Alternatively, the emitter 12 may be connected to the electro-magnetic radiation generator 8 by a high tension insulation cable or cables, which may, for example, be co-axial or fibre optical cables. This alternative is shown in FIG. 3.

The use of a high tension insulated cable 23 is preferred in situations where the proximity of the electromagnetic radiation generator 8 to the combustion chamber 2 subjects the electro-magnetic radiation generator 8 to excessive heat which may emanate from the combustion chamber 2. Such excessive heat may adversely impact on the performance of the electro-magnetic radiation generator 8. Such high tension insulated cables 23 may be of the co-axial or fibre optical type and are well insulated with an outer metallic jacket 25 to prevent electro-magnetic radiation escaping therefrom, The connection points of the cables 23 from the electro-magnetic radiation generator 8 to the emitter 12 are also securely fastened and insulated to prevent electro-magnetic radiation leakage. The connection points between the cables 23 and the emitter 12 are also insulated, e.g. by a cap 25.

Figure 3:
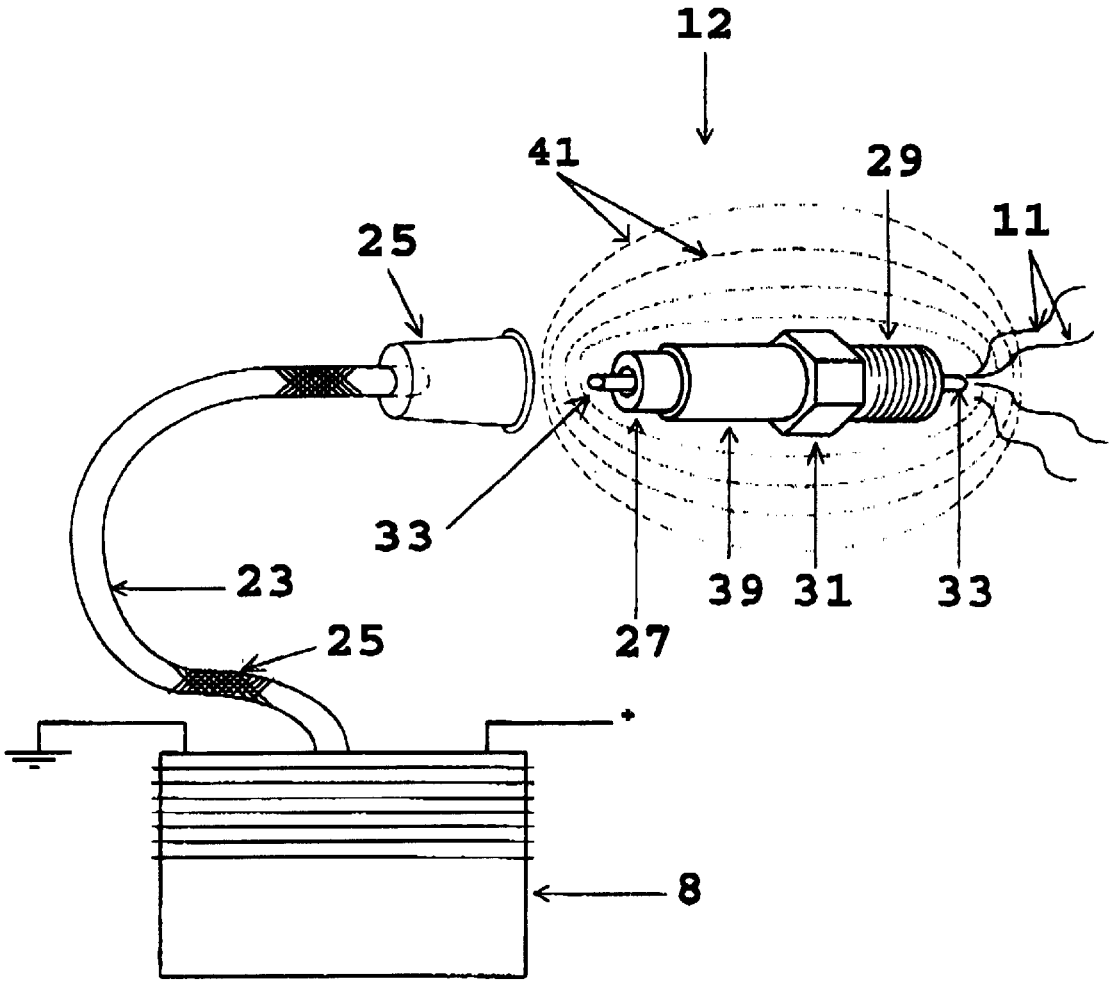
FIG. 3 is a schematic drawing showing an embodiment of the emitter and connection to the electro-magnetic generator.
Figure 4:
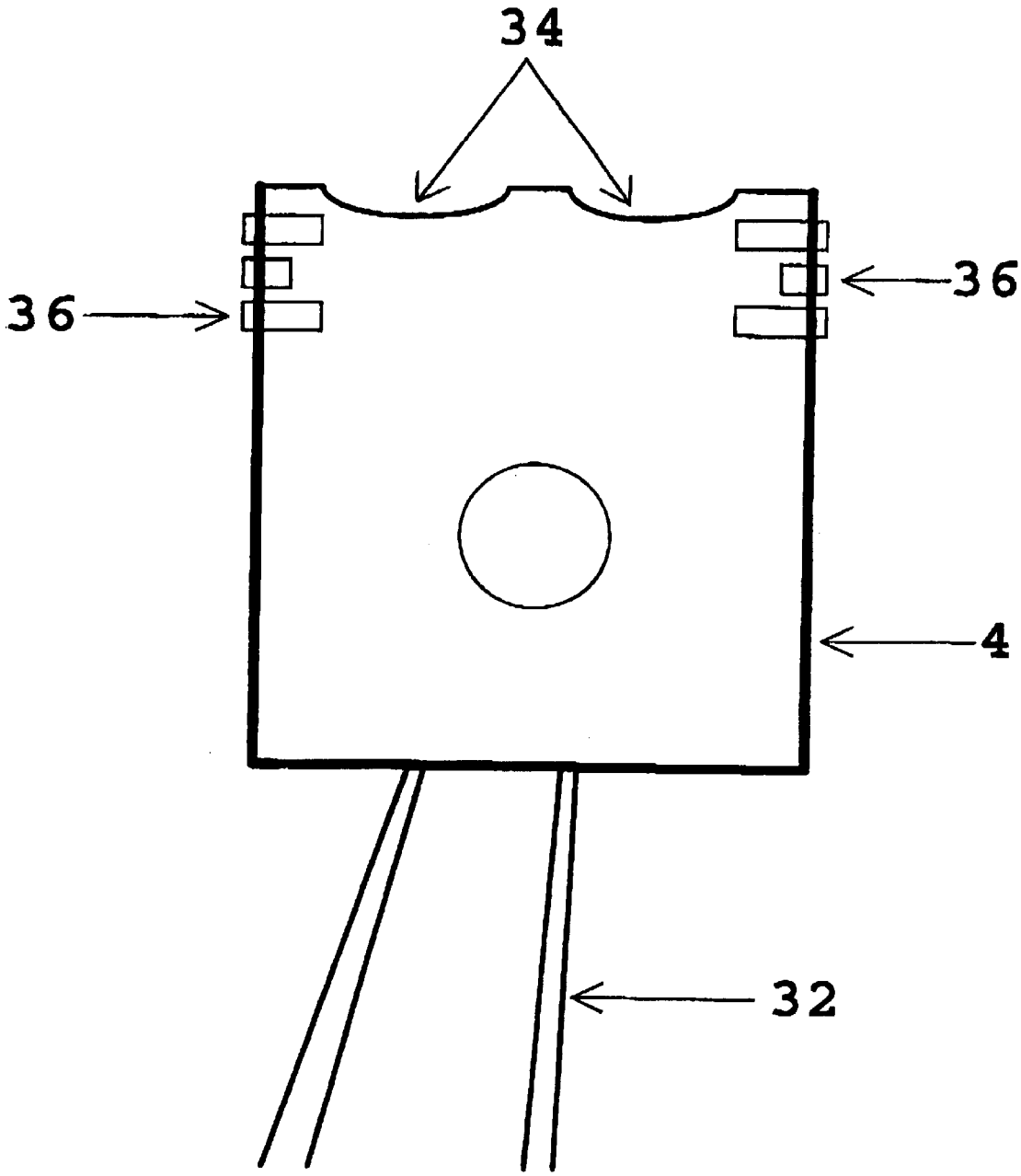
FIG. 4 shows the piston shown in the embodiments of FIGS. 1 and 2.

In FIG. 3, the emitter 12 is shown having a structure resembling that of a conventional spark plug. A ceramic core insulator 27, threaded stub 29 and (hexagonal) nut 31 are provided. The emitter 12 is also provided for an electrode 33 for connection to the cable 23 and for emission of the electro-magnetic radiation 11. In the case of the emitter 12 being provided with an in-built magnet this is shown by the sleeve 39. The magnetic field created by the magnet 39 is shown at 41. Alternatively, the sleeve 39 may be non-magnetic in which case it is a metallic insulator.

Other embodiments of emitters 12 may also be used.

The electro-magnetic radiation generator 8 is insulated to prevent interference. For example, when the electro-magnetic radiation generator 8 is provided as a magnetron generating microwaves, insulation is provided to prevent radio interference.

The fuel atomising nozzle 6 and the emitter 12 are arranged such that they are opposed in an offset manner. As can be seen in FIG. 1, they are offset by an angle of substantially 90°.

An inlet valve 24 is provided for intake of air during the respiration cycle of the ignition system 1. The inlet valve 24 allows air to enter the combustion chamber 2 for stoichiometric mixtures and combustion of the fuel 10. The inlet valve 24 may be a one-way valve for intake of air.

An exhaust valve 26 is provided for exhaust of combustion products from the combustion chamber 2.

A pressure relief valve (not shown) may also be provided such that if the internal pressure in the combustion chamber 2 exceeds a selected level, the pressure relief valve is actuated to avoid over pressurisation in the combustion chamber 2.

The electro-magnetic radiation generator 8 is connected to an electronic timer 28. The electronic timer 28 uses square gating pulses in lieu of decaying sign waves to accurately coordinate bursts of electro-magnetic radiation into the combustion chamber 2 at pre-determined positions of the piston 4 within the combustion chamber 2.

Preferably, the electronic timer 28 is set so that electro-magnetic radiation 11 is emitted by the emitter 12 from about 18° prior to piston 4 reaching top dead centre to prior to, or at, the completion of the downward stroke of the piston 4 to enhance heating and substantially complete ionisation and combustion of the fuel 10 in the combustion chamber 2.

Attached to the end of the piston arm 32 which is remote from the piston 4, there is schematically shown a flywheel 30. Connection leads 45 extend between the flywheel 30 and the electronic timer 28. This enables appropriate signals to be sent from the flywheel 30 to the electronic timer 28 to control the duration of the bursts of electro-magnetic radiation 11 generated by the electro-magnetic radiation generator 8 and emitted by the emitter 12.

The piston 4 is provided with cavities 34 in the surface which bounds the combustion chamber 2. The cavities 34 enhance reflection of the electro-magnetic radiation 11 off the piston 4 in different directions.

The piston 4 is provided with a series of piston rings 36 which seal against the inside wall 38 of the combustion chamber 2.

A power source 48 provides the power for the initial starting energy input to the electro-magnetic radiation generator 8.

An alternator 37 is also provided so that after initial starting, electrical power for the operation of the electro-magnetic radiation generator 8 can be provided by the alternator 37.

Figure 2:
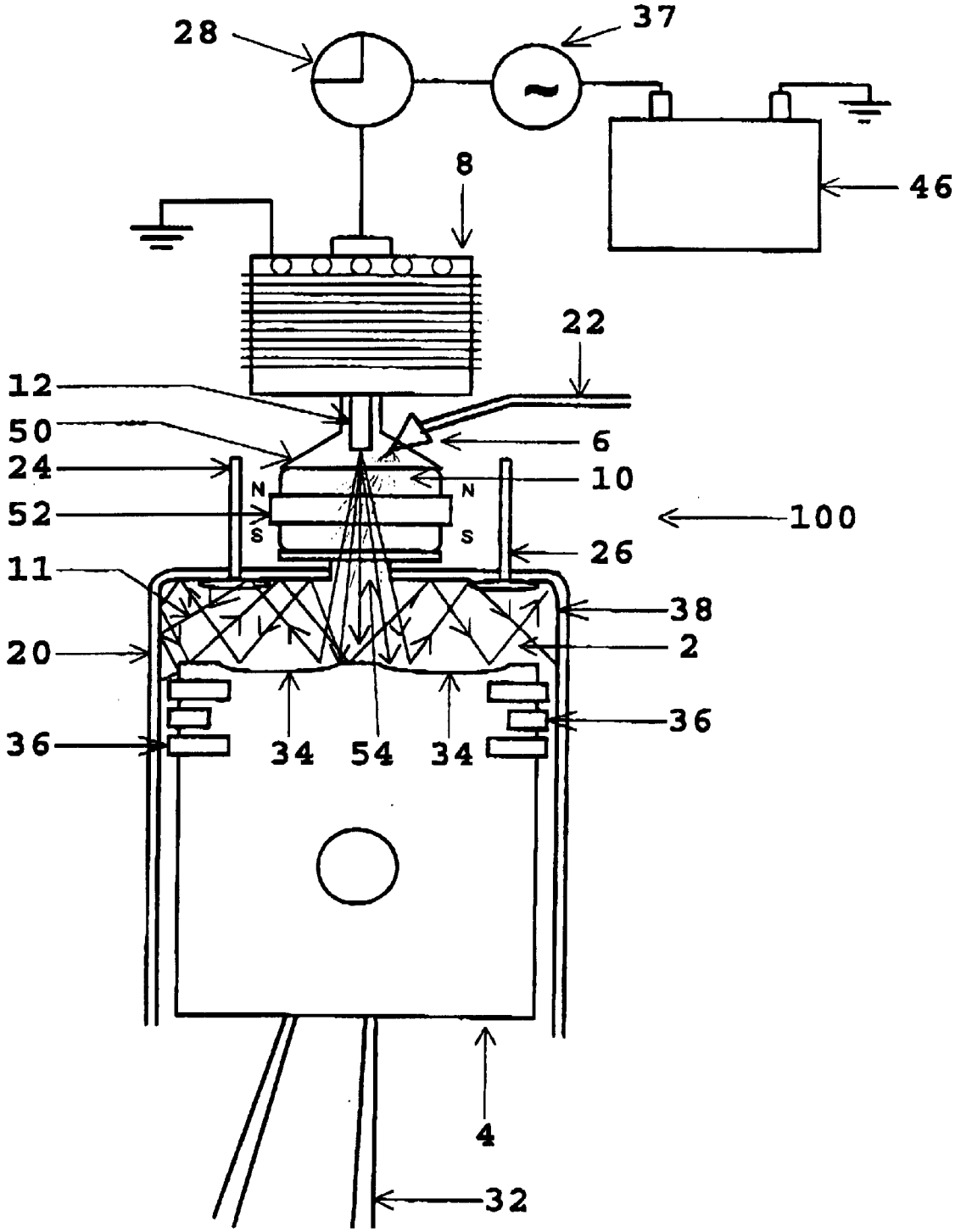
FIG. 2 is a schematic drawing showing a second embodiment of an ignition system in accordance with an aspect of the present invention.

In FIG. 2, there is shown a second embodiment of an ignition system 100 in accordance with the present invention. The ignition system 100 is similar to the ignition system 1 except in relation to the arrangement of the electro-magnetic radiation generator 8 and emitter 12 and the fuel atomising nozzle 6 and provision of a pre-combustion chamber 50. Accordingly, the same reference numerals used in the description of the first embodiment of the ignition system 1 are used in the following description of the second embodiment of the ignition system 100. It is to be understood that these parts are similar and operate in a similar manner.

The pre-combustion chamber 50 is arranged such that it communicates with the combustion chamber 2.

The emitter 12 emits electro-magnetic radiation 11, generated by the electro-magnetic generator 8, into the pre-combustion chamber 50. In addition, the fuel atomising nozzle 6 sprays fuel 10 into the pre-combustion chamber 50. A magnet 52 is provided to create a magnetic field in the pre-combustion chamber 50.

Fuel is ionised and magnetised, in the pre-combustion chamber 50 and is able to pass from the pre-combustion chamber 50 to the combustion chamber 2 via the communication port 54.

In other respects, the ignition system 100 is similar to the ignition system 1.

Whilst not wanting to be bound to any particular theory as to the operation of the ignition system and method of the present invention, the manner of operation of the ignition systems 1 and 100 will now be described incorporating a description of some of the theory underlying the operation of the ignition systems 1 and 100. The following description will also include specific references to the operation of the ignition systems 1 and 100 in the case of the fuel being water.

The electro-magnetic radiation generator 8 is initially activated via a power source 46. Subsequently, power is provided by the alternator 37. Fuel 10 is sprayed into the combustion chamber 2, or the pre-combustion chamber 50, under elevated pressure in the form of a fine mist or fog of fuel droplets during the respiration cycle of the engine in which the ignition system 1 or 100 is provided. The large surface area to volume ratio of the fuel droplets enhances stoichiometric mixtures and absorption of electro-magnetic radiation emitted by the emitter 12 to cause rapid heating and expansion of the fuel 10. In the case of water, this rapid heating and expansion results in ultra-superheated steam above the critical point of vaporisation of the water.

Air is allowed to enter the combustion chamber 2 via the inlet 24 during respiration cycles. The inert gases in the air provide elasticity upon heating thereof.

The electro-magnetic radiation 10 is emitted by the emitter 12 in bursts which are coordinated and synchronised with the movement of the piston 4 and flywheel 30 via signals passing from the flywheel 30 to the timer 28 which then controls the operation of the electro-magnetic radiation generator 8. Preferably, the electro-magnetic radiation 11 is emitted by the emitter 12 just prior to the piston 4 reaching top dead centre, e.g. 18° before top dead centre, and continuing for part, or all, of the downward stroke of the piston 4 to thereby complete the ionisation, heating and combustion cycle.

The operation of the fuel atomising nozzle 6 is synchronised with the operation of the electro-magnetic radiation generator 8 and emitter 12 such that fuel 10 is sprayed into the combustion chamber 2, or pre-combustion chamber 50, at the same time that electro-magnetic radiation 11 is emitted by the emitter 12.

The electro-magnetic radiation 11 emitted by the emitter 12 is incapable of penetrating or escaping through the walls of the combustion chamber 2, or pre-combustion chamber 50, and is thereby trapped causing a violent arcing phenomenon within the combustion chamber 2, or pre-combustion chamber 50, and also causing extreme illuminance. The entrained fuel mist molecules absorb energy from the electro-magnetic radiation 11 continually being reflected around within the combustion chamber 2, or pre-combustion chamber 50.

The electro-magnetic radiation will cause heating, ionisation and nuclear magnetic resonance of the fuel 10 during the compression stroke. This will cause the fine mist fuel particles to dissociate rapidly and separate into constituent atoms of the fuel 10. In the case of the fuel being water, the water is separated into the two hydrogen atoms and the single oxygen atom of the water molecule. This will follow after the water droplets become magnetised and saturated with energy created by the electro-magnetic radiation 11 and are not able to absorb sufficient heat above 100° C. (boiling point of water). Due to the increased pressure differential within the combustion chamber caused by the piston 4 being at or near top dead centre, the water will continue absorbing additional heat above the boiling point of 100° C. However, in the presence of the electro-magnetic radiation 11, the water vapour will transform into ultra-superheated steam and via Larmor precessional motion will dissociate into hydrogen and oxygen atoms.

In the case of water, the dissociated oxygen atoms will provide the oxygen for the hydrogen atoms to combust. However, the intake 24 also operates to introduce air for the stoichiometric combustion process, thereby introducing inert gases into the combustion chamber 2, or pre-combustion chamber 50.

The presence of a magnetic field in the combustion chamber 2 and pre-combustion chamber 50 (via the magnet 18 in the ignition system 1 and the magnet 52 in the ignition system 100, for example) enhances the nuclear magnetisation and combustion of the fuel 10. The fuel atom isotopes created via the gyromagnetic motions and via a perturbation caused by the electro-magnetic radiation at the corresponding frequency atomic precession and atomic relaxation will cause the high spin temperature atoms to give up their acquired internal energies during the combustion process.

The electro-magnetic radiation 11 emitted by the emitter 12, in the range as previously described herein, includes resonant frequencies for the hydrogen and other atoms in the fuel, e.g. oxygen. This is the case whether the fuel is water, hydrocarbon fuel, alcohols or other hydrogen rich substances, e.g. sugars.

In the case of water, a preferred resonant frequency is 1420 MHz which corresponds to the nuclear magnetic resonant frequency of hydrogen. At 1420 MHz hydrogen atoms become excited via nuclear magnetic resonance and will break their valances and separate from the one oxygen atom.

Different atoms resonate at different frequencies and so other frequencies may also be used as the resonant frequency. Magnetic field strength also affects the frequencies at which atoms undergo nuclear magnetisation and atomic resonance.

Thus, the atomic ionisation and nuclear magnetisation of the fuel 10 in the combustion chamber 2, or the pre-combustion chamber 50, in the presence of a magnetic field (as previously hereinbefore described) causes the fuel 10 to overheat, ionise, dissociate and combust (in the combustion chamber 2) during the compression stroke of the piston 4 causing an explosion which will force the piston 4 to travel downwards (as viewed In FIGS. 1 and 2) and create rotational movement of the engine crankshaft 43. The continued emission of electro-magnetic radiation 11 by the emitter 12 during the down stroke, or part of the down stroke, of the piston 4 enhances heating, complete ionisation and combustion of the fuel 10 in the combustion chamber 2. Emission of electro-magnetic radiation 11 by the emitter 12 during only part of the down stroke of the piston 4 provides opportunity for the fuel atoms to give up their acquired internal energies prior to the commencement of the exhaust cycle.

The above described cycle is repeated as the piston returns from the end of its downward travel back up toward top dead centre.

Resultant exhaust emissions exit via the exhaust outlet 26 prior to the piston 4 again reaching its position on its upward stroke where the combustion cycle is reinitiated by emission of electro-magnetic radiation 11 by the emitter 12 and introduction of fuel 10 by the fuel atomising nozzle 6.

In the case of the fuel 10 being water, the exhaust will be primarily steam and pressure (along with any exhaust resulting from any additives to the water). Thus, the exhaust will be predominantly clean without the usual level of the toxic hydrocarbon bi-products which result from conventional hydrocarbon fuels.

Air drawn into the combustion chamber 2 via the inlet 24 has two principal effects. Firstly, the oxygen in the air will assist in providing a stoichiometric fuel-air mixture for the combustion process of the fuel. Secondly, inert gases such as nitrogen and argon (as part of the air) that are drawn into the combustion chamber 2 during the respiration cycle do not combust. However, they expand when subjected to heating and assist in providing elasticity to drive the piston 4 downwards. In this regard, such gases operate in a similar manner in the ignition system 1, 100 of the present invention as when using fossilised fuels or liquefied gases as the fuel.

Typically, the stoichiometric ratio for combustion of gasoline is between 14 to 16 parts of air to 1 part gasoline. Where water is used as the fuel in this invention, the stoichiometric ratio for combustion of hydrogen is 8 parts oxygen to 1 part hydrogen.

Where the fuel used is water, the water may be fresh water, distilled water, filtered salt water, filtered brackish water, filtered re-processed or filtered recycled waste water, although is not limited to the foregoing.

The use of resonant frequency electro-magnetic radiation, particularly in the presence of a magnetic field, causes the hydrogen atoms present in the fuel to attain a high spin temperature, to resonate and to dissociate from the other atoms in the fuel.

The ignition system of the present invention may provide a number of advantages over conventional ignition systems. Some of these are described below.

The ignition system of the present invention enables a more efficient combustion of fuel, whether the fuel be water, hydrocarbons, alcohols, combustible gases or hydrogen rich compounds. Many applications of the ignition system of the present invention should see a reduction in the quantities of toxic exhaust components if and when the fuel used is a hydrocarbon.

In the case of water being used as a fuel, there are additional advantages. For instance, no toxic components would be contained in the exhaust (other than possibly those arising from small quantities of additives to the water fuel). When water is used as fuel, the exhaust components are steam and pressure. Steam is formed when the hydrogen and oxygen atoms recombine to form water when the emitter ceases emitting electro-magnetic radiation. This occurs on the up stroke of the piston. The steam in the exhaust may be collected and condensed (e.g. using a condenser) and returned to the fuel reservoir for reuse in the ignition system. This provides a further advantage since it is not necessary to have large reservoirs of fuel for feeding to the ignition system. Also, the use of water as a fuel is safer than using hydrocarbons since water does not combust at ambient temperatures. These advantages are particularly relevant to the transport, aviation and marine industries since vehicles, aircraft and marine-craft could carry significantly reduced fuel reservoirs. In addition, the use of hydrocarbon fuel reservoirs in conventional vehicle, aircraft and marine-craft presents the danger of fuel explosions and fires in the case of collisions or other accidents. Use of water as a fuel would eliminate this potential hazard.

Other advantages which may be provided by use of water as a fuel include elimination of carbon deposits in the combustion chamber. This should see a longer engine life and also yield a longer service life.

Other advantages of the ignition system of the present invention will be apparent to a skilled addressee.

Modifications and variations such as would be apparent to a skilled addressee are deemed to be within the scope of the present invention.

Throughout this specification, unless the context requires otherwise, the word "comprise", or variations such as "comprises" or "comprising", will be understood to imply the inclusion of a stated integer or group of integers but not the exclusion of any other integer or group of integers.

What is claimed is:

1. Ignition system comprising fuel atomising means for spraying fuel therefrom for introduction into a combustion chamber, electro-magnetic radiation generator means to generate electro-magnetic radiation, emitter means connected with said electro-magnetic radiation generator means to emit said electro-magnetic radiation generated by said electro-magnetic radiation generator means, and magnetic field creation means positioned exterior of the combustion chamber in proximity to said fuel atomising means, wherein said magnetic field creation means is provided to create at least one magnetic field and said electro-magnetic radiation emitted by said emitter means irradiates fuel in the presence of said at least one magnetic field created by said magnetic field creation means heat and ionise fuel and combust fuel in the combustion chamber.

2. Ignition system according to claim 1, wherein said at least one magnetic field enhances atomic ionisation and causes nuclear magnetisation of selected atoms of said fuel.

3. Ignition system according to claim 1, wherein said magnetic field creation means comprises at least one magnet.

4. Ignition system according to claim 3, wherein said emitter means is provided with said at least one magnet.

5. Ignition system according to claim 3, wherein said at least one magnet is a ceramic magnet.

6. Ignition system according to claim 3, wherein said at least one magnet is a rare earth magnet.

7. Ignition system according to claim 3, wherein said at least one magnet is an electro-magnet.

8. Ignition system according to claim 1, wherein said at least one magnetic field creates a magnetic flux density of approximately 0.05 Tesla to approximately 2.0 Tesla.

9. Ignition system according to claim 1, wherein said electro-magnetic radiation generator means generates resonant frequency electro-magnetic radiation for heating and ionisation of said fuel.

10. Ignition system according to claim 1, wherein said electro-magnetic radiation generator means generates electro-magnetic radiation whose frequencies are in the range of approximately 100 MHz to approximately 100 GHz.

11. Ignition system according to claim 10, wherein said electro-magnetic radiation has a frequency of approximately 1420 MHz.

12. Ignition system according to claim 1, wherein said electro-magnetic radiation generator means has an energy output from approximately 200 watts to approximately 10000 watts.

13. Ignition system according to claim 1, wherein said electro-magnetic radiation generator means comprises a magnetron or klystron.

14. Ignition system according to claim 1, wherein said electro-magnetic radiation generator means is connected directly with said emitter means.

15. Ignition system according to claim 1, wherein said emitter means is connected with said electro-magnetic generator means by waveguide means.

16. Ignition system according to claim 1, wherein said emitter means emits said electro-magnetic radiation in bursts at pre-set times of the combustion cycle of the ignition system.

17. Ignition system according to claim 16, further comprising timing means arranged to generate square gating pulses such that said electro-magnetic radiation is emitted by said emitter means at said pre-set times.

18. Ignition system according to claim 16, wherein said pre-set times correspond to predetermined positions of a reciprocating piston located in said combustion chamber.

19. Ignition system according to claim 17, wherein said timing means is arranged such that said emitter means emits said electro-magnetic radiation from substantially 18° prior to said reciprocating piston reaching top dead centre to prior to, or at, the completion of the downward stroke of said reciprocating piston to enhance complete ionisation and combustion of said fuel in said combustion chamber.

20. Ignition system according to claim 1, wherein said emitter means is arranged to emit said electro-magnetic radiation into said combustion chamber, said fuel atomising means is arranged to spray said fuel into said combustion chamber and said at least one magnetic field is created in said combustion chamber such that said fuel is heated, ionised and combusted in said combustion chamber.

21. Ignition system according to claim 1, wherein pre-combustion chamber means is provided and said emitter means emits said electro-magnetic radiation into said pre-combustion chamber means and said fuel atomising means sprays said fuel into said pre-combustion chamber means such that said fuel is heated and ionised in said pre-combustion chamber means.

22. Ignition system according to claim 21, wherein at least one magnetic field is created in said pre-combustion chamber means.

23. Ignition system according to claim 22, wherein said pre-combustion chamber means has at least one magnet to create said magnetic field.

24. Ignition system according to claim 21, wherein said pre-combustion chamber means and said combustion chamber are in communication such that said electro-magnetic radiation and said fuel are able to pass from said pre-combustion chamber means to said combustion chamber.

25. Ignition system according to claim 1, wherein said fuel atomising means sprays fuel therefrom as a mist or fog of droplets.

26. Ignition system according to claim 25, wherein said droplets have a mean value diameter of up to approximately 1000 microns.

27. Ignition system according to claim 26, wherein said droplets have a mean value diameter of up to approximately 100 microns.

28. Ignition system according to claim 26, wherein said droplets have a mean value diameter of approximately 1 to approximately 5 microns.

29. Ignition system according to claim 1, wherein said fuel is sprayed from said fuel atomising means under elevated pressure.

30. Ignition system according to claim 29, wherein fuel injector means is provided such that said fuel is sprayed under elevated pressure.

31. Ignition system according to claim 29, wherein pump means is provided such that said fuel is sprayed under elevated pressure.

32. Ignition system according to claim 29, wherein said fuel is sprayed at a pressure in the range from approximately 50 bar to approximately 250 bar.

33. Ignition system according to claim 1, wherein said fuel comprises water, wherein the water molecules are heated and dissociated into hydrogen and oxygen atoms and the hydrogen atoms are subsequently ionised and combusted.

34. Ignition system according to claim 1, wherein said fuel comprises hydrocarbon compounds, wherein the molecules of said hydrocarbon compounds are heated and dissociated into constituent atoms and the hydrogen atoms are subsequently ionised and combusted.

35. Ignition system according to claim 33, wherein said fuel includes at least one additive to enhance combustion.

36. Ignition system according to claim 35, wherein said additives are selected from the group including hydrocarbon fuels, alcohols, sugars, calcium cyclamate, gases and chemical additives.

37. Ignition system according to claim 1, wherein said inlet means is provided for intake of air into said combustion chamber during the respiration cycle of said ignition system.

38. Ignition system according to claim 37, wherein said inlet means comprises a one way valve for intake of air.

39. Ignition system according to claim 1, wherein exhaust means is provided for exhaust of combustion products from said combustion chamber.

40. Ignition system according to claim 1, wherein pressure relief means is provided such that if the internal pressure in said combustion chamber exceeds a selected level, said pressure relief means is activated to avoid over-pressurisation in said combustion chamber.

41. Ignition system according to claim 1, wherein a reciprocating piston is provided in said combustion chamber, said reciprocating piston having at least one cavity therein to enhance reflection of said electro-magnetic radiation off said piston in different directions.

42. Ignition system according to claim 1, wherein said fuel atomising means sprays said fuel in a direction substantially at 90° angulation through said at least one magnetic field.

43. Ignition system according to claim 1, wherein said fuel atomising means and said emitter means are arranged such that they are opposed in an offset manner.

44. Ignition system according to claim 43, wherein said fuel atomising means and said emitter means are offset by an angle of substantially 90°.

45. Ignition system according to claim 1, wherein heating plug means is provided to provide additional heating of said fuel.

46. Ignition system according to claim 1, wherein a power source is provided for initial starting energy input to said electro-magnetic radiation generator means.

47. Ignition system according to claim 1, wherein alternator means is provided to supply energy input to said electro-magnetic radiation generator means following initial starting.

48. Ignition system according to claim 1, wherein it is installed as a retrofit system in a pre-existing engine.

49. Ignition system according to claim 20, wherein said magnetic field creation means comprises at least one magnet provided on a casing of said combustion chamber.

50. Ignition system according to claim 20, wherein said combustion chamber contains a reciprocating piston.

51. Ignition system according to claim 49, wherein said magnetic field creation means comprises at least one magnet provided on a piston head of said reciprocating piston.

52. Ignition system according to claim 1, further comprising additional magnetic field creation means to create at least one additional magnetic field.

53. Ignition system according to claim 52, wherein said additional magnetic field creation means comprises at least one additional magnet provided on a pistion head of a reciprocating piston provided in said combustion chamber.

54. Ignition system according to claim 53, wherein said additional magnet is selected from the group consisting of a ceramic magnet, a rare earth magnet and an electro-magnet.

55. A method of ignition of fuel in a combustion chamber comprising generating and emitting electro-magnetic radiation, spraying fuel from fuel atomising means for introdution into the combustion chamber, creating at least one magnetic field from exterior of the combustion chamber in proximity to the fuel atomising means and irradiating fuel with said electro-magnetic radiation in the presence of said at least one magnetic field to heat and ionise fuel and combust fuel.

56. A method according to claim 52, wherein said at least one magnetic field is provided to enhance atomic ionisation and provide nuclear magnetisation of selected atoms of said fuel.

57. A method according to claim 53, wherein the said magnetic field creates a magnetic flux density of approximately 0.05 Tesla to approximately 2.0 Tesla.

58. A method according to claim 55, wherein electromagnetic radiation is generated whose frequencies are in the range of approximately 100 MHz to approximately 100 GHz.

59. A method according to claim 58, wherein said electromagnetic radiation has a frequency of approximately 1420 MHz.

60. A method according to claim 55, wherein said electromagnetic radiation is emitted in bursts at pre-set times of a combustion cycle.

61. A method according to claim 60, wherein said electromagnetic radiation is emitted from a time substantially 18° prior to a piston, reciprocating in a combustion chamber in which said fuel is combusted, reaches top dead centre to a time prior to, or at, the completion of the downward stroke of said piston to enhance complete ionisation and combustion of said fuel.

62. A method according to claim 55, wherein said electromagnetic radiation is emitted into said combustion chamber, said fuel is introduced into said combustion chamber and said at least one magnetic field is created in said combustion chamber such that said fuel is heated, ionised and combusted in said combustion chamber.

63. A method according to claim 55, wherein said electromagnetic radiation is emitted into pre-combustion chamber means and said fuel is introduced into said pre-combustion chamber means such that said fuel is heated and ionised and said pre-combustion chamber means.

64. A method according to claim 55, wherein said fuel is sprayed as a mist or fog of droplets.

65. A method according to claim 64, wherein said droplets have a mean value diameter of up to approximately 1000 microns.

66. A method according to claim 65, wherein the said droplets have a mean value diameter of up to approximately 100 microns.

67. A method according to claim 66, wherein the said droplets have a mean value diameter of approximately 1 to approximately 5 microns.

68. A method according to claim 55, wherein said fuel is sprayed under elevated pressure.

69. A method according to claim 68, wherein the said fuel is sprayed at a pressure in the range from approximately 50 bar to approximately 250 bar.

70. A method according to claim 55, wherein said fuel is dissociated into its constituent atoms and subsequently ionised and combusted.

71. A method according to claim 55, wherein at least one additive is added to the fuel to enhance combustion.

72. A method according to claim 55, wherein air is intaken into the combustion chamber during a respiration cycle.

73. A method according to claim 55, wherein combustion products are exhausted from said combustion chamber.

74. A method according to claim 55, wherein pressure in said combustion chamber is released if it is exceeds a selected level to thereby avoid over-pressurisation in said combustion chamber.

75. A method according to claim 55, wherein said fuel is sprayed in a direction substantially at 90° angulation through said at least one magnetic field.

76. A method according to claim 55, wherein said electromagnetic radiation is emitted and said fuel is sprayed such that they are opposed in an offset manner.

77. A method according to claim 76, wherein said electromagnetic radiation is emitted and said fuel is sprayed such that they are offset by an angle of substantially 90°.

78. Ignition system according claim 1, wherein said electromagnetic radiation generator means generates electro-magnetic radiation having a pulsed wave form.

79. Ignition system according to claim 1, wherein said electro-magnetic radiation generator means generates electro-magnetic radiation having a continuous wave form.

80. Ignition system according to claim 1, wherein said fuel comprises a substance or substances capable of ionisation and combustion by electro-magnetic radiation.

81. A method according to claim 55, wherein said electromagnetic radiation comprises resonant frequency electromagnetic radiation to ionise said fuel.

82. A method according to claim 55, wherein said electromagnetic radiation comprises resonant frequency electromagnetic radiation to heat and ionise said fuel.

83. A method according to claim 63, wherein at least one magnetic field is created in said pre-combustion chamber means.

84. A method according to claim 71, wherein said additive is selected from the group including hydrocarbon fuels, alcohols, sugars, calcium cyclamate, gases and chemical additives.

85. A method according to claim 55, wherein said electromagnetic radiation has a pulsed wave form.

86. A method according to claim 55, wherein said electromagnetic radiation has a continuous wave form.

87. A method according to claim 55, wherein said fuel comprises at least one substance capable of ionisation and combustion by electro-magnetic radiation.

88. A method according to claim 55, wherein said fuel comprises water, wherein the water molecules are heated and dissociated into hydrogen and oxygen atoms and the hydrogen atoms are subsequently ionised and combusted.

89. A method according to claim 55, wherein said fuel comprises hydrocarbon compounds, wherein the molecules of said hydrocarbon compounds are heated and dissociated into constituent atoms and the hydrogen atoms are subsequently ionised and combusted.

90. A method according to claim 55, wherein a reciprocating piston is provided in the combustion chamber, and said method further comprises creating at least one additional magnetic field by providing said piston with a magnet to create said at least one additional magnetic field.

* * * * *